US006389254B2

(12) United States Patent
Ishiyama et al.

(10) Patent No.: US 6,389,254 B2
(45) **Date of Patent: *May 14, 2002**

(54) CHARGING MEMBER HOLDING CHARGE ACCELERATING PARTICLES IN A CONTINUOUS BUBBLE

(75) Inventors: Harumi Ishiyama, Numazu; Yasunori Chigono, Susono; Jun Hirabayashi, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,896

(22) Filed: Aug. 30, 1999

(30) Foreign Application Priority Data

Sep. 4, 1998 (JP) ..... 10-267397

(51) Int. Cl.[7] ..... G03G 15/02
(52) U.S. Cl. ..... 399/176; 399/174

(58) Field of Search ..... 399/50, 168, 174, 399/175, 176

(56) References Cited

U.S. PATENT DOCUMENTS

| | | | | |
|---|---|---|---|---|
| 4,851,960 A | | 7/1989 | Nakamura et al. | 361/225 |
| 5,359,395 A | * | 10/1994 | Shimura et al. | 399/176 |
| 5,774,769 A | * | 6/1998 | Chigono et al. | 399/176 |
| 5,809,374 A | | 9/1998 | Tsuda et al. | 399/111 |
| 6,023,597 A | * | 2/2000 | Mayuzumi et al. | 399/176 |

FOREIGN PATENT DOCUMENTS

| | | |
|---|---|---|
| JP | 05-150539 | 6/1993 |
| JP | 07-99442 | 10/1995 |

* cited by examiner

*Primary Examiner*—Sandra Brase
(74) *Attorney, Agent, or Firm*—Fitzpatrick, Cella, Harper & Scinto

(57) ABSTRACT

A charging member has an electrically conductive base material and a surface layer including a foaming body of a continuous bubble material.

12 Claims, 5 Drawing Sheets

CHARGING MEMBER HOLDING CHARGE ACCELERATING PARTICLES IN A CONTINUOUS BUBBLE

BACKGROUND OF THE INVENTION

1. Field of the Invention

This invention relates to a charging member and a charging device suitably used in an image forming apparatus of the electrophotographic type to charge a member to be charged such as a photosensitive member.

2. Related Background Art

In an image forming apparatus such as an electrophotographic apparatus or an electrostatic recording apparatus, a corona charger (corona discharger) has heretofore been often used as a charging device for uniformly charging (and removing charges) an image bearing member (a member to be charged) such as an electrophotographic photosensitive member or an electrostatic recording dielectric member to a required polarity and potential.

The corona charger is a noncontact type charging device and is provided, for example, with a discharge electrode such as a wire electrode and a shield electrode surrounding the discharge electrode, and a discharge opening portion is disposed in an opposed noncontact relationship with the image bearing member which is a member to be charged, and a high voltage is applied to the discharge electrode and the shield electrode to thereby create a discharge current (corona shower), and the surface of the image bearing member is exposed to the discharge current to thereby charge the surface of the image bearing member to a predetermined polarity and potential.

[Contact Charging]

Recently, a charging device of the contact type (contact charging device) for charging a member to be charged by the charging member to which a voltage has been applied as previously described being brought into contact with the member to be charged has been put into practical use owing to the advantages of low ozone, low electric power, etc. as compared with the corona charger.

The contact charging device is such that an electrically conductive charging member of the roller type (charging roller), the fur brush type, the magnetic brush type, the blade type or the like is brought into contact with a member to be charged such as an image bearing member and a predetermined charging bias is applied to this charging member (a contact charging member or a contact charger, and hereinafter referred to as the contact charging member) to thereby charge the surface of the member to be charged to a predetermined polarity and potential.

The charging mechanism of contact charging (the mechanism of charging or the principle of charging) mixedly includes two kinds of charging mechanisms, i.e., (1) a discharge charging mechanism and (2) a direct injection charging mechanism, and depending on which mechanism is dominant, each characteristic presents itself.

(1) Discharge Charging Mechanism

This is a mechanism in which the surface of the member to be charged is charged by a discharge phenomenon occurring in the minute gap between the contact charging member and the member to be charged.

The discharge charging mechanism has a constant discharge threshold value for the contact charging member and the member to be charged and therefore, it is necessary to apply a voltage greater than the charging potential to the contact charging member. Also, as compared with a corona charger, it is unavoidable in principle for a discharge product to be produced though the quantity thereof produced is markedly small, and therefore the ill effects caused by active ions such as ozone is unavoidable.

For example, the charging system using an electrically conductive roller (charging roller) as the contact charging member is preferable in respect of the stability of charging and is widely used, but in this roller charging, the discharge charging mechanism is dominant as the charging mechanism thereof.

That is, the charging roller is produced by the use of an electrically conductive or medium-resistance rubber material or a foamed material. Further, there is also a charging roller of a laminated construction to thereby obtain a desired characteristic. The charging roller is given elasticity in order to obtain constant contact with the member to be charged, but therefore it is great in frictional resistance and in many cases, it is driven following the member to be charged or with some difference from the latter. Accordingly, a noncontact state is unavoidable due to the irregularity of the shape of the roller or the material adhering to the member to be charged and therefore, in the conventional roller charging, the discharge charging mechanism becomes dominant as the charging mechanism thereof.

More specifically, when a charging roller is pressed and made to abut against an OPC photosensitive member having a thickness of 25 $\mu$m as a member to be charged and a charging process is carried out, the surface potential of the photosensitive member begins to rise if a voltage of about 640 V or greater is applied to the charging roller, whereafter the surface potential of the photosensitive member linearly increases with an inclination 1 to the applied voltage. Hereinafter, this threshold value voltage is defined as a charging starting voltage Vth.

That is, to obtain the surface potential Vd of the photosensitive member required for electrophotography, a DC voltage of Vd+Vth greater than required becomes necessary for the charging roller. A system of applying only a DC voltage to the contact charging member in this manner to thereby effect the charging of an image bearing member is referred to as the "DC charging system".

In the DC charging system, however, the resistance of the contact charging member is fluctuated by the fluctuation of the environment or the like and Vth is fluctuated if the film thickness is changed by the photosensitive member as the image bearing member being shaved and therefore, it has been difficult to render the potential of the photosensitive member into a desired value.

Therefore, in order to achieve the further uniformization of charging, as disclosed in U.S. Pat. No. 4,851,960, use is made of an "AC charging system" of applying to a contact charging member a vibration voltage comprising an AC component having a peak-to-peak voltage of 2×Vth or greater superposed on a DC voltage corresponding to desired Vd to thereby effect the charging of an image bearing member. This is directed to the level effect of potential by AC, and the potential of the image bearing member is converged to Vd which is the center of the peak of the AC voltage, and is not affected by the disturbance of the environment or the like.

(2) Direct Injection Charging Mechanism

This is a mechanism in which charges are directly injected from a contact charging member into a member to be charged to thereby charge the surface of the member to be charged. It is proposed in U.S. Pat. No. 5,809,379, etc.

A contact charging member of medium-resistance contacts with the surface of the member to be charged to thereby effect the direct injection of charges into the surface of the member to be charged without the intermediary of a discharge phenomenon, i.e., basically without using a discharging mechanism. Consequently, even if the applied voltage to the contact charging member is equal to or less than a discharge threshold value, the member to be charged can be charged to the potential corresponding to the applied voltage. This direct injection charging mechanism is not accompanied by the production of ions and therefore does not give rise to the ill effects caused by the production of.

More specifically, this is a mechanism in which a voltage is applied to a contact charging member such as a charging roller, a charging brush or a charging magnetic brush and charges are injected into a charge holding member for a trap order or electrically conductive particles or the like of a charge injection layer lying on the surface of a member to be charged (an image bearing member) to thereby effect direct injection charging. Since the discharge phenomenon is not dominant, the voltage required for charging is only on the desired surface of the image bearing member and there is no production of ozone.

FIG. 5 of the accompanying drawings shows an example of the charging characteristics of the discharge charging mechanism described under item (1) above and the direct injection charging mechanism described under item (2) above.

That is, in the discharge charging mechanism, as represented by the graph A of FIG. 5, charging begins after a discharge threshold value of about −500 V is passed. Accordingly, when the member to be charged is to be charged to −500 V, it is popular to apply a DC voltage of −1000 V or apply a DC charging voltage of −500 V, and apply an AC voltage of peak-to-peak voltage 1200 V so as to always have a potential difference of the discharge threshold value or greater to thereby converge the potential of the member to be charged to the charging potential.

On the other hand, in the direct injection charging mechanism, there is no discharge threshold value as represented by the graph B of FIG. 5, and it becomes possible to obtain a charging potential substantially proportional to the applied bias.

[Toner Recycle Process (Cleanerless System)]

In an image forming apparatus of the transfer type, any untransferred toner remaining on a photosensitive member (image bearing member) after transfer is removed from the surface of the photosensitive member by a cleaner (cleaning device) and becomes waste toner, but it is desirable from the viewpoint of environmental protection that such waste toner is not produced. So, there has also appeared an image forming apparatus of toner recycle process made into an apparatus construction in which a cleaner is eliminated and any untransferred toner on a photosensitive member after transfer is removed from the photosensitive member by "cleaning simultaneous with development" by the use of a developing device and collected and reused into the developing device for reuse.

The cleaning simultaneous with development is a method of collecting any toner remaining on the photosensitive member after transfer by continuously charging the photosensitive member during the development after the next step, exposing the photosensitive member to thereby form a latent image, and applying a fog-removing bias (a fog-removing potential difference Vback which is the potential difference between a DC voltage applied to the developing device and the surface potential of the photosensitive member) during the development of the latent image. According to this method, the untransferred toner is collected into the developing device and reused after the next step and therefore, the waste toner can be eliminated and the cumbersomeness of maintenance can be reduced. Also, the advantage in terms of space is great due to being cleanerless, and it becomes possible to make the image forming apparatus very compact.

[Application of Powder to the Contact Charging Member]

With regard to a contact charging device, a construction in which powder is applied to the surface of contact of the contact charging member with the surface of the member to be charged to prevent uneven charging and effect stable uniform charging is disclosed in Japanese Patent Publication No. 7-99442. However, although the contact charging member is rotated following the member to be charged and the production of ozone products is markedly small as compared with a corona charger such as a scorotron, the principle of charging still relies chiefly on the discharge charging mechanism as in the case of the aforedescribed roller charging. Particularly, to obtain the more stable uniformity of charging, the production of ozone products by discharge becomes more because a voltage comprising an AC voltage superposed on a DC voltage is applied.

Also, in Japanese Patent Application Laid-Open No. 5-150539, there is disclosed an image forming method using contact charging wherein a developer contains at least visualizing particles and electrically conductive particles having an average particle diameter smaller than that of the visualizing particles in order to prevent the hindrance to charging by toner particles and silica fine particles adhering to the surface of charging means while image formation is repeated for a long time.

As noted in the above-described prior art, in contact charging, powder is applied to the surface of contact of the contact charging member with the surface of the member to be charged in order to prevent uneven charging and effect stable uniform charging, but the application of this powder is difficult and has led to problems that a) it is difficult to uniformly apply the powder to the surface of the charging member and the application of the powder becomes liable to be non-uniform, and b) the application of the powder is uniform at the initial stage, but the powder becomes liable to be peeled by duration and becomes non-uniform.

SUMMARY OF THE INVENTION

It is an object of the present invention to provide a charging member capable of holding electrically conductive particles on the surface thereof.

It is another object of the present invention to provide a charging device capable of charging through electrically conductive particles.

It is still another object of the present invention to provide a charging member comprising an electrically conductive base material, and a surface layer including a foaming body of a continuous bubble type.

It is yet still another object of the present invention to provide a charging device comprising a member to be charged, a charging member for contacting with the member to be charged to thereby charge the member to be charged, said charging member having a surface layer including a foaming body of a continuous bubble material, and charge accelerating particles held in the bubble of the surface layer.

Further objects of the present invention will become apparent from the following description.

DESCRIPTION OF THE PREFERRED EMBODIMENTS

Embodiment 1

Figure 1:
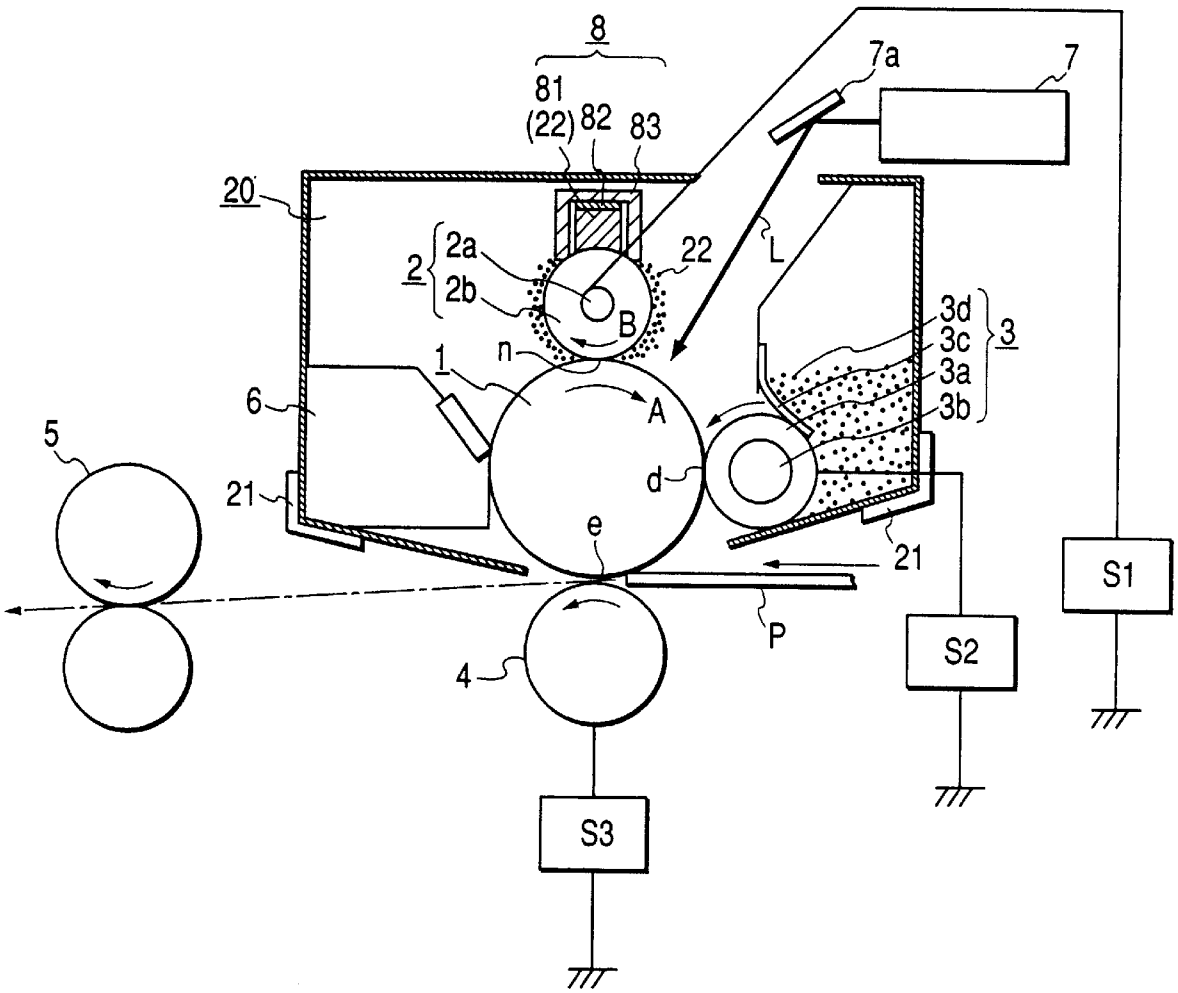
FIG. 1 schematically shows the construction of an image forming apparatus according to Embodiment 1 of the present invention.
Figure 2:
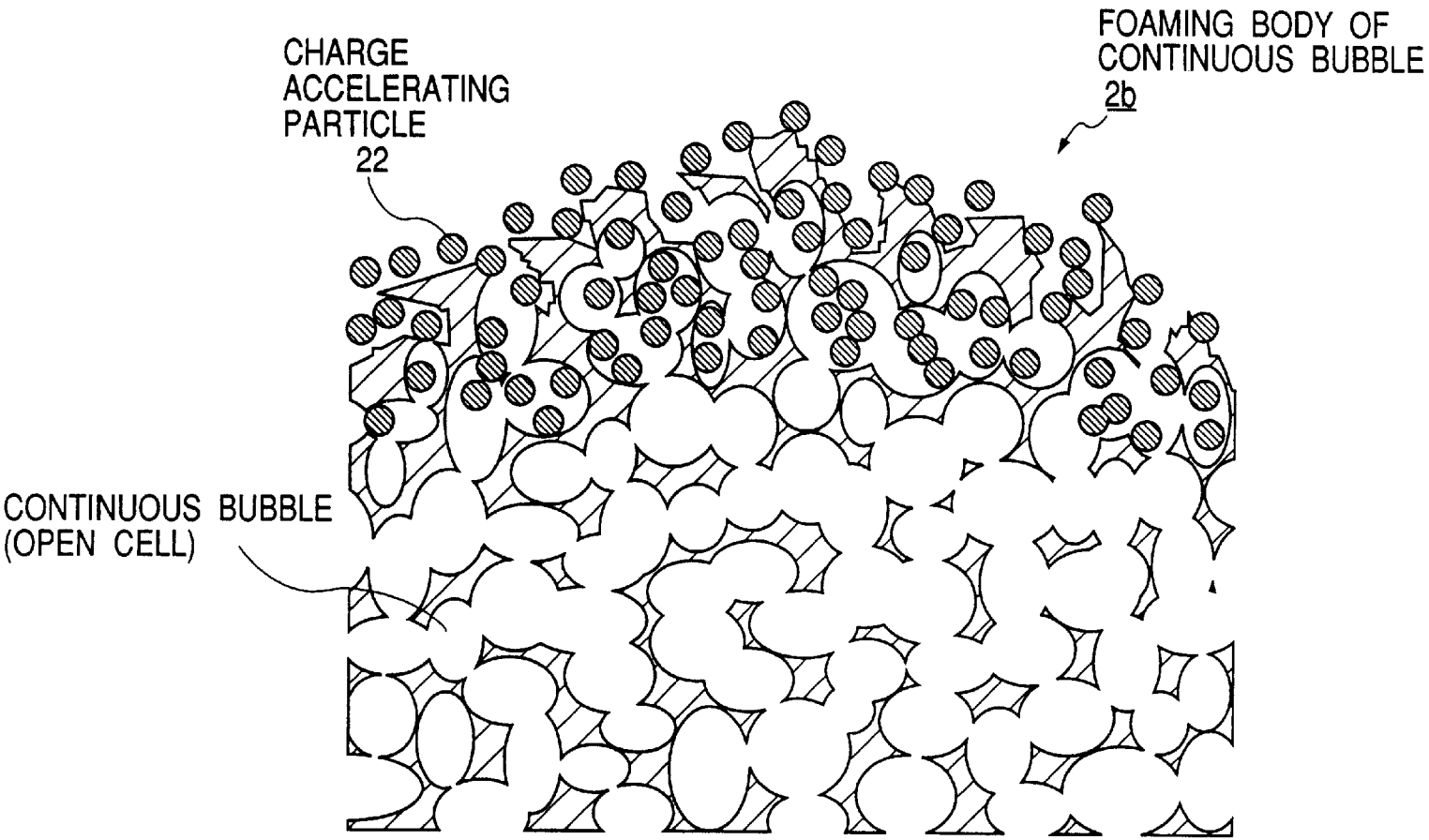
FIG. 2 is a typical view showing the texture of a contact charging member formed of the elastic foaming body of a continuous bubble and a state in which it is impregnated with charge accelerating particles.

(FIGS. 1 and 2)

This embodiment is an example of a contact charging device using the elastic foaming body of a continuous bubble as a charging member to cause the charging member to stably bear charge accelerating particles thereon and thereby enable direct injection charging to be effected, and an image forming apparatus which can thereby obtain a stable charging property and images free of uneven charging for a long period of time from the early stage of the use of the apparatus.

The image forming apparatus of the present embodiment is a laser printer (recording apparatus) utilizing the transfer type electrophotographic process and of the contact charging type of direct injection charging and of the process cartridge attaching-detaching type.

(1) General Schematic Construction of the Printer

Referring to FIG. 1, the reference numeral 1 designates a rotatable drum type OPC photosensitive member of ϕ 30 mm (a negative photosensitive member, hereinafter referred to as the photosensitive drum) as an image bearing member (a member to be charged) rotatively driven in the direction of arrow A at a constant speed of the peripheral velocity of 50 mm/sec.

The reference numeral 2 denotes a contact charging member for the photosensitive member 1, and in the present embodiment, it is a roller-shaped charging roller having a diameter of 12 mm comprising a core metal 2*a* and a medium-resistance layer 2*b* made of a continuous bubble material. The surface of this charging roller 2 is coated in advance with charge accelerating particles (electrically conductive particles) 22. Also, the reference numeral 8 designates charge accelerating particle supplying means for the charging roller 2.

The charging roller 2, the charge accelerating particles 22 and the charge accelerating particle supplying means 8 will be described later in detail.

The charging roller 2 is brought into contact with the photosensitive drum 1 with a predetermined nip width formed with a predetermined pressure force against the elasticity thereof. The letter n designates the charging nip portion (charging portion) between the charging roller 2 and the photosensitive drum 1.

Also, the charging roller 2, in the present embodiment, is rotatively driven at about 80 rpm so as to be moved at an equal speed in the clockwise direction of arrow B, i.e., a direction counter to the direction of rotation of the photosensitive drum 1 at the charging nip portion n, and contacts with the surface of the photosensitive drum 1 with a speed difference relative to the latter.

A predetermined charging voltage is applied from a charging bias applying voltage source S1 to this charging roller 2, whereby the surface of the rotatable photosensitive drum 1 is uniformly contact-charged to a predetermined polarity and potential. In the present embodiment, as the charging voltage, a DC voltage of −700 V was applied from the charging bias applying voltage source Si to the roller mandrel 2*a* of the charging roller 2.

In the present embodiment, the contact charging of the photosensitive drum 1 by the charging roller 2 is effected with direct injection charging becoming dominant due to the presence of charge accelerating particles, and the surface of the rotatable photosensitive member is charged to a potential substantially equal to the applied charging voltage to the charging roller 2. This will be described later in detail.

The reference numeral 7 denotes a laser beam scanner (exposure device) including a laser diode, a polygon mirror, etc. This laser beam scanner outputs a laser beam L intensity-modulated correspondingly to the time-series electrical digital pixel signal of desired image information, and scans and exposes the uniformly charged surface of the rotatable photosensitive drum 1 by this laser beam. A mirror member 7*a* deflects the output laser beam L of the laser beam scanner 7 toward the exposed portion of the photosensitive drum 1. By this scanning and exposure, an electrostatic latent image corresponding to the desired image information is formed on the surface of the rotatable photosensitive drum 1.

The electrostatic latent image on the surface of the rotatable photosensitive drum 1 is developed as a toner image by a developing device 3. The developing device 3 in the present embodiment is a reversal developing device using a magnetic monocomponent insulating toner (negative toner) 3*d*. The reference character 3*a* designates a nonmagnetic rotatable developing sleeve including a fixed (nonrotatable) magnet roll 3*b* therein and rotatively driven at a predetermined peripheral velocity in the counterclockwise direction shown by the arrow.

The magnetic monocomponent insulating toner 3*d* in the developing device 3 is magnetically restrained and held as a toner layer on the outer surface of the developing sleeve 3*a* by the magnetic force of the magnet roll 3*b*, is carried with the rotation of the developing sleeve 3*a*, has its layer thickness regulated by a regulating blade 3*c* in the process of being carried, and has charges imparted thereto, and is carried to a developing region d which is the opposed portion between the photosensitive drum 1 and the developing sleeve 3*a* and reversal-develops the electrostatic latent image on the surface of the rotatable photosensitive drum 1 as a toner image.

A predetermined developing voltage is applied from a developing bias applying voltage source S2 to the developing sleeve 3*a*. In the present embodiment, the developing voltage comprises a DC voltage of −500 V and a rectangular AC voltage of a frequency 1800 Hz and peak-to-peak voltage 1600 V superposed thereon.

The magnetic monocomponent insulating toner 3*d* as the developer in the present embodiment was made by mixing connecting resin, a coloring material, magnetic material particles, a charge controlling agent, etc. together, and via the steps of mulling pulverizing and classification, and further by extraneously adding a fluidizing agent. The weight average particle diameter (D7) of the toner was 7 $\mu$m.

The reference numeral 4 denotes a medium-resistance and elastic rotatable transfer roller as a contact transferring means which is urged against the photosensitive drum 1 to thereby form a transfer nip portion (transfer portion) e.

A recording material (transfer material) P as a recording medium is fed from a sheet feeding portion, not shown, to this transfer nip portion e at predetermined timing, and a predetermined transfer voltage is applied from a transfer bias applying voltage source S3 to the transfer roller 4, whereby the toner image on the photosensitive drum 1 is transferred to the surface of the transfer material P fed to the transfer nip portion e.

In the present embodiment, the resistance value of the roller was $5\times10^8$ Ω and a DC voltage of +2000 V was applied thereto to effect transfer. That is, the recording material P introduced into the transfer nip portion e is nipped and conveyed by this transfer nip portion e and the toner image formed and borne on the surface of the rotatable photosensitive drum 1 is sequentially transferred to the surface of the recording material by an electrostatic force and a pressure force.

The reference numeral 5 designates a fixing device of the heat fixing type or the like. The recording material P fed to the transfer nip portion e and having received the transfer of the toner image on the photosensitive drum 1 is separated from the surface of the rotatable photosensitive drum 1 and is introduced into this fixing device 5, and has the toner image thereon fixed and is discharged as an image forming article (a print or a copy) out of the apparatus.

The reference numeral 6 denotes a cleaning device (cleaner), and the surface of the photosensitive drum after the transfer of the toner image to the recording material P is subjected to the removal of an adhering contaminant such as residual toner by this cleaning device 6 and is repetitively used for image formation.

The printer of the present embodiment is an apparatus of a cartridge type having process instruments such as the photosensitive drum 1, the charging roller 2 as the contact charging member, the charge accelerating particle supplying means 8, the developing device 3 and the cleaning device 6 included in a cartridge 20 and collectively detachably attachable to the main body of the apparatus. The combination or the like of the process instruments made into a process cartridge is not restricted to what has been described above, but may be arbitrary. The reference numeral 21 designates the attaching-detaching guide and holding members of the process cartridge 20. In the present invention, the image forming apparatus is not restricted to an apparatus of the cartridge type.

(2) Charging Roller 2

The charging roller 2 is made by forming a medium-resistance layer 2*b* of the foaming body made of a continuous bubble material on the core metal 2*a*.

The medium-resistance layer 2*b* was prescribed by resin (e.g. urethane), electrically conductive particles (e.g. carbon black), a sulfidizing agent, a foaming agent or the like, and was formed into a roller-like shape on the core metal 2*b*. Thereafter, an elastic electrically conductive roller 2 as a charging roller having its surface polished as required and having a diameter of 12 mm and a longitudinal length of 200 mm was made. As a typical continuous bubble material, mention may be made of Rubycell (trade name), Raulen (trade name) or the like produced by Toyo Polymer Co., Ltd.

Here, the continuous bubble is a bubble in which, as shown in the enlarged model view of FIG. 2, the cells of the foaming body 2*b* are not completely surrounded by cell film, but communicate with adjacent cells. Such a bubble is called a communication bubble or an open cell, besides a continuous bubble.

When the roller resistance of the charging roller 2 in the present embodiment was measured, it was 100 kΩ. The roller resistance was measured by applying a voltage of 100 V to between the mandrel 2*a* and an aluminum drum with the charging roller 2 brought into pressure contact with the aluminum drum of ϕ 30 mm so that a load of total pressure 1 kg might be applied to the mandrel 2*a* of the charging roller 2.

It is important for the charging roller 2 which is a contact charging member to function as an electrode, and it needs to have elasticity and obtain a sufficient state of contact with the member to be charged and at the same time, have sufficiently low resistance to charge the moved member to be charged. On the other hand, however, when a low pressure resistance faulty region such as a pinhole is present in the member to be charged, it is necessary to prevent the leak of the voltage. When an electrophotographic photosensitive member is used as the member to be charged, the resistance of $10^4$ to $10^7$ Ω is desirable to obtain a sufficient charging property and leak resistance.

(3) Charge Accelerating Particles 22

In the present embodiment, as charge accelerating particles 22, use was made of electrically conductive zinc oxide particles having specific resistance of $3\times10^3$ Ω·cm and an average particle diameter of 4.5 μm.

As the charge accelerating particles, use can be made of various electrically conductive particles such as the electrically conductive inorganic particles of other metal oxide or a mixture with organic materials.

As regards the particle resistance, in order to effect the exchange of charges through the particles, the specific resistance may desirably be $10^{12}$ Ω·cm or less, and more preferably be $10^{10}$ Ω·cm or less. If the resistance value becomes too low, the particles come to have no triboelectricity and therefore, the resistance value may preferably be $10^{-2}$ Ω·cm or greater.

The resistance of the particles was measured by the pellet method and normalized and found. That is, a powder sample of about 0.5 g was put into a cylinder having a bottom surface area 2.26 $cm^2$ and pressurization of 15 kg was effected on upper and lower electrodes and at the same time, a voltage of 100 V was applied thereto and the resistance value thereof was measured and thereafter was normalized and the specific resistance was calculated.

In order to obtain good uniformity of charging, the particle diameter may desirably be 50 μm or less. In the present invention, the particle diameter when the particles constitute a cohering body was defined as the average particle diameter as the cohering body. For the measurement of the particle diameter, 100 or more particles were extracted from the observation by an optical or electronic microscope, and the volume particle size distribution was calculated with a horizontal maximum angular distance, and was determined with the average particle diameter of 50% thereof.

The charge accelerating particles are not only present in the state of primary particles, but there is no problem even if they are present in the state of cohering secondary particles. In whatever cohering state the charge accelerating particles may be, the form thereof is not important if the cohering body can realize the function as the charge accelerating particles.

The charge accelerating particles 22, particularly when used for the charging of the photosensitive drum, may approximately be colorless or nearly white particles so as not to hinder the exposure of the latent image. Further, when it is taken into consideration that some of the charge accelerating particles are transferred from the photosensitive member to the recording material, colorless or white particles are desirable in color recording, and it is preferable for the particles to be nonmagnetic. Also, in order to prevent the scattering of light by the particles during image exposure, the particle diameter may desirably be equal to or smaller than the size of constituent pixels. As the lower limit value of the particle diameter, 10 nm is considered to be the limit as that is stably obtained as particles.

The outer peripheral surface of the charging roller 2 is coated in advance with the above-described charge accelerating particles 22. As the coating method, the charge accelerating particles were uniformly applied to the outer peripheral surface of the charging roller 2 while being tapped by means of a brush so that the charge accelerating particles 22 might permeate into the interior of the elastic sponge layer (continuous bubble texture) 2*b* of the charging roller, as shown in the model view of FIG. 2.

By the charge accelerating particles 22 being tapped into the surface of the charging roller 2 in such a manner, the charge accelerating particles can be borne not only by the surface of the elastic layer 2*b* which is the continuous bubble texture of the charging roller, but also by the interior thereof to a certain extent as shown in the model view of FIG. 2.

Besides the above-described coating method, there is also a method of placing the charging roller into the charge accelerating particles and urging other roller or a brush or the like against it to thereby force the charge accelerating particles into the interior of the bubble (the interior of foaming cells) of the elastic layer 2*b* which is the continuous bubble texture of the charging roller.

(4) Charge Accelerating Particle Supplying Means 8

In the present embodiment, the charge accelerating particle supplying means 8 is comprised of a charge accelerating particle supplying member (charge accelerating particle chip) 61 (22), a supporting member 82 for the charge accelerating particle supplying member, a housing 83 in which the charge accelerating particle supplying member is contained, etc., and is disposed on the upper portion of the charging roller 2 and is designed to be capable of moving the underside of the charge accelerating particle supplying member 81 in the housing 83 toward and away from the upper surface of the charging roller 2.

The mechanism for moving the charge accelerating particle supplying member 81 toward and away from the upper surface of the charging roller 2, although not shown, can be effected by a cam type, an electromagnetic coil type or the like, and in the present embodiment, for each 300 sheets of image formation, within a predetermined time during which the charging roller 2 during nonimage formation makes one full rotation or greater, the charge accelerating particle supplying member 81 is brought into contact with the charging roller 2 by a cam to thereby effect the supply of the charge accelerating particles 22 to the charging roller 2.

The reason why the supply of the charge accelerating particles 22 to the charging roller 2 is effected during nonimage formation is that when the charge accelerating particles 22 are excessively supplied during image formation, the charge accelerating particles shift from the charging roller 2 onto the photosensitive drum 1 to thereby cause ill effects such as the light interception in the exposure portion and the developer leak in the developing portion.

The charge accelerating particle supplying member 81 is a member in which the charge accelerating particles 22 are bound and solidified into a chip-like shape (charge accelerating particle chip), and is a member which is shaved of itself like a chalk by the contact thereof with the rotating charging roller 2 to thereby apply and supply the charge accelerating particles 22 to the surface of the charging roller 2.

It is, for example, a chip-like one comprising the charge accelerating particles 22 of zinc oxide, alumina powder or the like bound in a solvent by binder resin. As specific prescription, styrene acryl resin as binder resin is dissolved in ethanol at the density of 5 wt %, and the charge accelerating particles 22 such as zinc oxide particles seven times as much as binder resin 1 in terms of weight are mixed with the binder resin. This solution is put into a mold and molded, and is dried, whereby there is obtained a charge accelerating particle supplying member 21 in a form in which the charge accelerating particles 22 are bound and solidified into a chip-like shape.

In the present embodiment, as the charge accelerating particles 22, use was made of zinc oxide powder having specific resistance of $3\times10^3$ Ω·cm and an average particle diameter of 4.5 μm.

(5) Direct Injection Charging (Direct Charging)

The contact charging of the photosensitive drum 1 is effected with the charge accelerating particles 22 present in the charging nip portion n between the photosensitive drum 1 and the charging roller 2.

That is, by the charge accelerating particles 22 being present in the charging nip portion n between the photosensitive drum 1 and the charging roller 2, it becomes possible that even the charging roller which was difficult to bring into contact with the photosensitive drum 1 with a speed difference therebetween because of the great frictional resistance is reasonably, easily and effectively brought into contact with the surface of the photosensitive drum 1 with a speed difference therebetween owing to the lubricating effect of the particles 22 and also, there is provided a construction in which the charging roller 2 comes into close contact with the surface of the photosensitive drum 1 with the particles 22 present therebetween, that is, the charge accelerating particles fill the unevenness of the charging roller which is the charging member and improve the contacting property thereof with the photosensitive drum 1 which is the member to be charged, whereby the charging roller contacts with the surface of the photosensitive drum 1 with a higher frequency.

A speed difference can be provided between the charging roller 2 and the photosensitive drum 1, whereby the chances of the charge accelerating particles 22 contact with the photosensitive drum 1 in the nip portion between the charging roller 2 and the photosensitive drum 1 can be markedly increased to thereby obtain a high contacting property, and the charge accelerating particles 22 present in the nip portion between the charging roller 2 and the photosensitive drum 1 rub against the surface of the photosensitive drum 1 without any gap, whereby charges can be directly injected to the photosensitive drum 1, and in the contact charging of the photosensitive drum 1 by the charging roller 2, direct injection charging becomes dominant due to the interposition of the charge accelerating particles.

In the present embodiment, a DC voltage of −700 V was applied to the core metal 2*a* of the charging roller 2. Thereby, the surface of the photosensitive drum 1 is directly injection-charged to a potential substantially equal to that applied voltage.

Usually, it is difficult to make the charge accelerating particles stably exist on the surface of the contact charging member, and when the charge accelerating particles necessary for charging are deficient, poor charging results. Also, the charge accelerating particles are supplied excessively, there occur ill effects such as the light interception in the exposure portion and the leak in the developing portion in an image forming apparatus, and there occurs an ill effect such as the fogging in the white ground portion in an image forming apparatus of the reversal development type.

In the present embodiment, the charging roller 2 of the elastic foaming body made of a continuous bubble material is used as the contact charging member and therefore, the charge accelerating particles 22 are stably borne in the continuous bubble material and a sufficient quantity of charge accelerating particles 22 is always maintained interposed in the charging nip portion n. Thereby, a stable charging property free of uneven charging is maintained from the early stage to long-term duration of the use of the apparatus.

That is, the charging roller 2 has a peripheral velocity difference relative to the photosensitive drum 1 and thus, not only the charge accelerating particles on the surface of the charging roller but also the charge accelerating particles included in the foaming cells near the surface separate from the inner wall and move to the surface of the charging roller when the surface of the charging roller is deformed by the peripheral velocity difference, and come to intervene in the nip portion n between the photosensitive drum 1 and the charging roller 2.

Also, thereby, it becomes unnecessary to supply the charge accelerating particles 22 to the charging roller 2 during each image forming operation, and the charging roller 2, which is a sponge roller made of a continuous bubble material can contain a great deal of charging particles therein, and the quantity of the charge accelerating particles supplied to the charging roller may be small and therefore, it becomes possible to reduce the frequency of supply.

So, in the present embodiment, as previously described, during nonimage formation at an interval of image formation of 300 sheets, the operation control of the charge accelerating particle supplying means 8 is done and the charge accelerating particle supplying member 81 contacts with the charging roller 2 to thereby supply supplementary charging particles.

Accordingly, there can be obtained high charging performance which could not be obtained by the conventional roller charging using chiefly discharge, and potential substantially equal to the potential applied to the contact charging member can be given to the member to be charged. Consequently, a voltage corresponding to the potential necessary for the member to be charged is sufficient as the bias necessary for charging, and stable and safe direct injection charging which does not use the discharge phenomenon can be realized.

When printing was effected in the above-described image forming apparatus, there did not occur poor images such as the light interception in the exposure portion and the leak of development, and uniform charging performance was obtained in the long-term use of the apparatus and good images could be maintained.

While in the present embodiment, the supply of the charge accelerating particles 22 to the charging roller 2 was done by bringing the chip-like member 81 of the charge accelerating particles into contact with the charging roller 2, this is not restrictive, but use may be made of a method of supplying the charge accelerating particles in the form of powder or a method of supplying the charge accelerating particles onto the photosensitive drum after charging.

Embodiment 2

(FIG. 3)

This embodiment is a cleanerless image forming apparatus using a charging device in which charge accelerating particles 22 are more stably held on the elastic layer 2*b* of a charging roller 2 which is the foaming body of a continuous bubble than in Embodiment 1.

Figure 3:
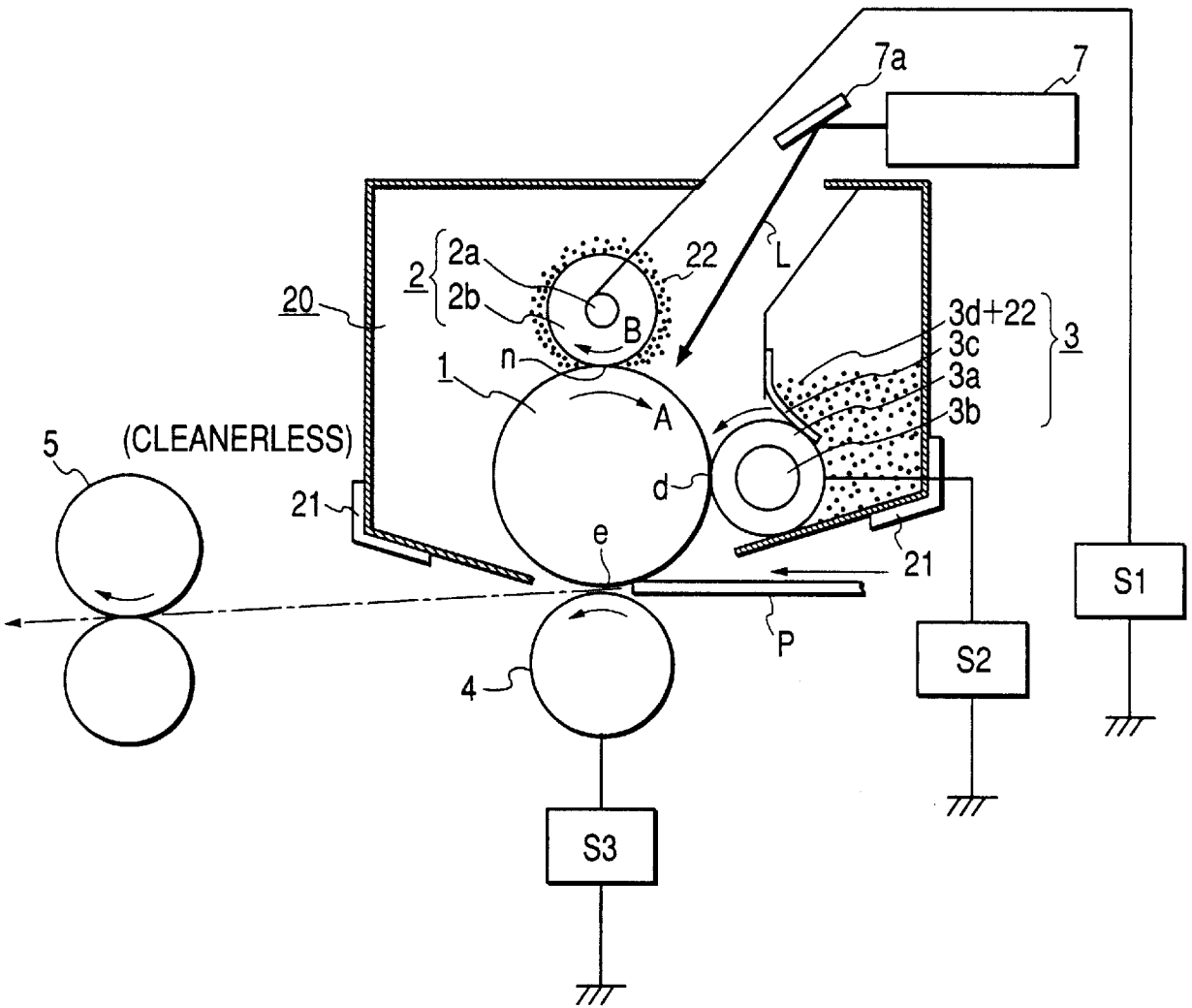
FIG. 3 schematically shows the construction of an image forming apparatus (cleanerless) according to Embodiment 2 of the present invention.

FIG. 3 schematically shows the construction of the image forming apparatus. In FIG. 3, constituent members and portions common to those of the image forming apparatus of Embodiment 1 are given the same reference characters and need not be described again.

(1) Process of Precoating the Charging Roller 2 With Charge Accelerating Particles 22

In the present embodiment, a sponge roller (a charging roller using the elastic foaming body made of a continuous bubble material) which is the charging roller 2 is precoated with charge accelerating particles 22 by the following method.

The charging accelerating particles 22 of zinc oxide used in Embodiment 1 were dispersed in ion-exchange water of the same weight and were rendered into a slurry state, and were uniformly applied to the surface of the sponge roller by a brush, and thereafter were dried at room temperature. In order to shorten the drying time, heating may be effected at such a degree of temperature that the sponge roller does not change in quality. As the solvent for effecting the dispersion, it is necessary to choose one which does not dissolve the sponge roller and the charge accelerating particles.

By impregnating the sponge roller with the charge accelerating particles in this manner, it is possible to impregnate not only the surface but also a certain extent of interior of the sponge roller with the charge accelerating particles because the sponge roller is made of a continuous bubble material. Consequently, it is possible to impregnate the sponge roller with more charge accelerating particles than in Embodiment 1. Consequently, more charge accelerating particles than in Embodiment 1 can be borne on the depth near the surface of the sponge roller. Thereby, a stable good charging property can be obtained for a longer time.

(2) Addition of Charge Accelerating Particles 22 to the Developer 3*d* in the Developing Device 3

The charge accelerating particles 22, as previously described, is applied in advance to the surface of the charging roller 2 and is added at a predetermined rate to the magnetic monocomponent insulating toner 3*d* which is the developer contained in the developing device 3. In the present embodiment, the amount of addition of the charge accelerating particles 22 to the developer 3*d* is 1 part by weight.

(3) Direct Injection Charging

The toner image obtained on the photosensitive drum 1 by development is transferred to the recording material P, but some of the toner remains as untransferred toner on the photosensitive drum. The printer of the present embodiment is cleanerless and therefore, the untransferred toner is intactly carried to the nip portion n between the photosensitive drum 1 and the charging roller 2. Since the conventional toner is an insulating material, the untransferred toner carried to the charging nip n causes bad charging.

In the present embodiment, however, the charge accelerating particles 22 are applied in advance to and present on the surface of the charging roller 2 and the charge accelerating particles 22 mixed with the developer 3*d* in the developing device 3 are carried to the nip portion n between the photosensitive drum 1 and the charging roller 2 via the developing and transferring steps and are supplied to the charging roller 2, whereby even when the toner mixes with the toner on the charging roller 2, the contacting property and contact resistance of the charging roller 2 with respect to the photosensitive drum 1 can be maintained by the charge accelerating particles 22 interposed in the nip portion n and therefore, as described in Embodiment 1, the charging by direct injection can be stably maintained from the initial stage of the use of the apparatus until after the long-term use of the apparatus.

Even if the charge accelerating particles 22 peel from the charge roller 2, the charge accelerating particles continuous to be supplied from the developing device 3 through the surface of the photosensitive drum and therefore, it becomes possible to stably maintain the charging property.

In the present embodiment, zinc oxide particles which are the charge accelerating particles 22 impregnating the interior of the continuous foaming body of the charging roller 2 are exposed to the surface of the charging roller by the deformation of the vicinity of the surface of the charging roller and the charge accelerating particles 22 extraneously added to the toner which is the developer in the developing device 3 are also present as the untransferred toner on the photosensitive drum 1 and are collected and held on the surface of the charging roller and therefore, the fine contacting property and contact resistance of the charging roller 2 with respect to the photosensitive drum 1 can be kept. Accordingly, direct injection charging of good charging uniformity becomes possible.

(4) Cleanerless System

As previously described, the printer is cleanerless, whereby the untransferred toner carried to the nip portion n between the photosensitive drum 1 and the charging roller 2 adheres to and mix with the charging roller 2, and is made negative (plus to minus) in the present embodiment by the friction thereof with the surface of the photosensitive drum and the charge accelerating particles 22, and is gradually electrically discharged from the charging roller 2 onto the photosensitive drum 1. In this case, the toner mixes with the charging roller (temporary collection of the toner) while being disturbed by minute projections on the surface of the charging roller, but in the present embodiment, simultaneously with the toner, the charge accelerating particles are also collected and held by the charging roller and therefore, the charging roller 2 can keep fine contact and contact resistance with respect to the photosensitive drum 1. Accordingly, direct injection charging becomes possible. The toner which has been mixed with the charging roller 2 is gradually discharged from the charging roller 2 because in the present embodiment, the continuous bubble foaming of the surface of the charging roller becomes a temporary buffer. By the charge accelerating particles 22 being borne on the charging roller 2, the adhering force of the untransferred toner adhering to and mixing with the charging roller 2 is reduced and the discharging efficiency of the toner from the charging roller 2 onto the photosensitive drum 1 is improved.

The toner discharged from the charging roller 2 onto the photosensitive drum 1 comes to the developing region d with the rotative movement of the surface of the photosensitive drum 1, and is again collected (cleaning simultaneous with development) or used for development in the developing device 3 (toner recycle).

The cleaning simultaneous with development is such that as previously described, the residual toner on the photosensitive drum 1 after transfer is collected by continuously charging the photosensitive drum during the development which is the next image forming step, exposing it and forming a latent image, and applying a fog removing bias of the developing device, i.e., a fog removing potential difference Vback which is the voltage difference between the Dc voltage applied to the developing device and the surface potential of the photosensitive drum, during the development of the lateral image. In the case of reversal development as in the printer of the present embodiment, this cleaning simultaneous with development is done by the action of an electric field for collecting the toner onto the developing sleeve from the dark portion potential of the photosensitive drum, and an electric field for making the toner adhere to the light portion potential of the photosensitive drum from the developing sleeve.

By repeating the above-described steps, direct injection charging is effected while making the toner recycle possible, and particularly in the present embodiment, a sponge charging roller of continuous foaming is used and therefore, the charge accelerating particles are stably present near the surface of the charging roller and thus, a uniform charging property is obtained for a long period of time and good images can be maintained. The untransferred toner and the charge accelerating particles are introduced onto the charging roller 2 while being disturbed and therefore, there can be obtained a uniform output image free of ghosts caused by the untransferred toner.

Embodiment 3

(FIG. 4)

This embodiment is such that in the cleanerless image forming apparatus of Embodiment 2, the pre-application of the charge accelerating particles 22 to the charging roller 2 is effected in the manner described under item (1) below, and the photosensitive drum 1 is of the construction described under item (2) below. In the other points, the apparatus construction of this embodiment is the same as that of the apparatus of Embodiment 2.

In the present embodiment, an electric field is utilized for the pre-application of the charge accelerating particles 22 to the charging roller 2, and charging is effected more stably and uniformly by adjusting the resistance of the surface layer of the photosensitive member. That is, even when the untransferred toner mixes with the charging roller and the contact area is reduced, the exchange of charges is effected more efficiently by the interposition of the charge accelerating particles and by setting the surface resistance of the photosensitive member to a low level in the area capable of forming a latent image.

(1) Process of Pre-applying the Charge Accelerating Particles 22 to the Charging Roller 2

In the present embodiment, the sponge roller which is the charging roller 2 is put into the charge accelerating particles 22, and a voltage of −100 V is applied to the sponge roller 2 and a fur brush connected to the earth is lightly brought into contact with the sponge roller to thereby electrically force the charge accelerating particles 22 into the interior of the continuous bubble of the sponge.

By the vicinity of the surface of the sponge roller being impregnated with the charge accelerating particles in this manner, more charge accelerating particles than in Embodiment 1 can be borne on the surface of the sponge roller. Also, thereby, a more stable good charging property can be obtained for a long period of time.

(2) Photosensitive Drum 1

Figure 4:
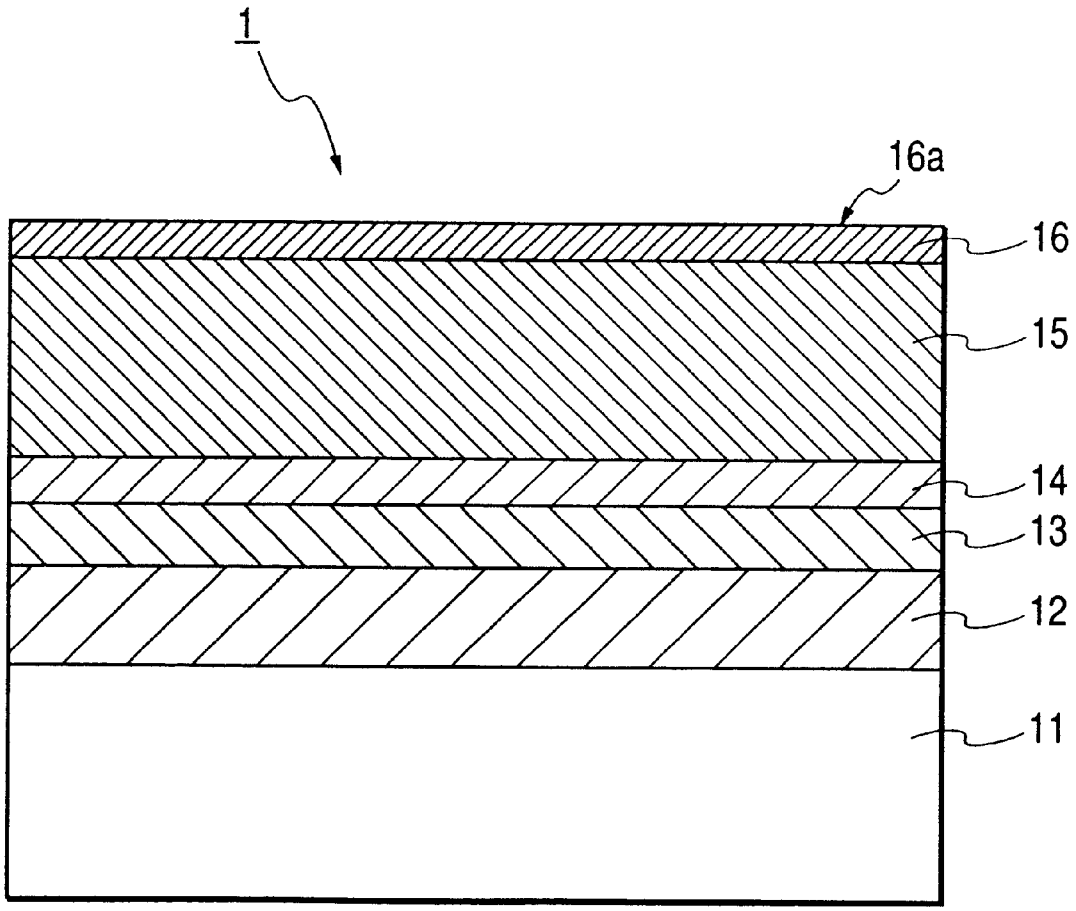
FIG. 4 is a model view of the layer construction of a photosensitive drum used in Embodiment 3 of the present invention.
Figure 5:
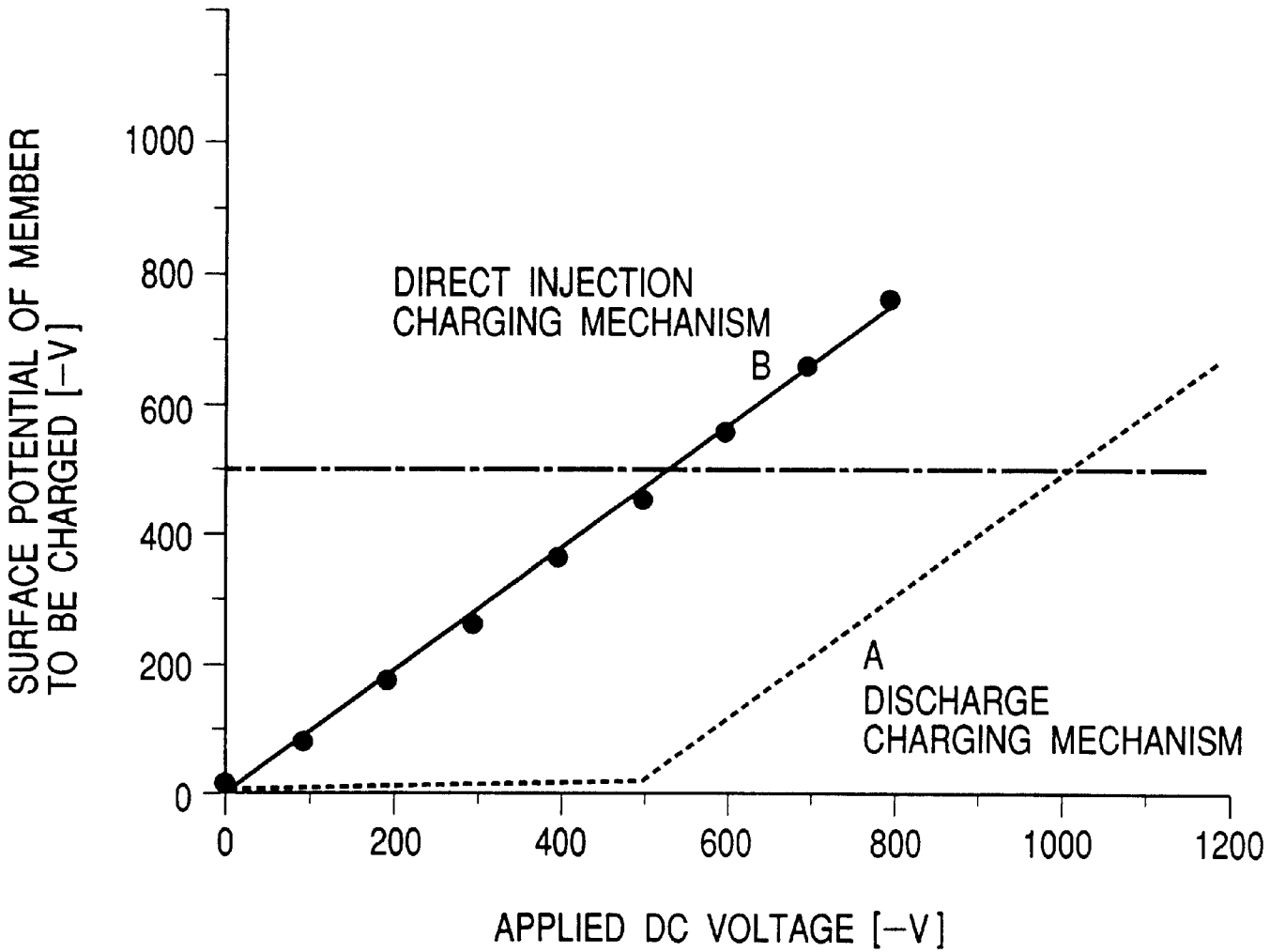
FIG. 5 is a charging characteristic graph.

FIG. 4 is a typical cross-sectional view showing the layer construction of the photosensitive drum 1 used in the present embodiment.

This photosensitive drum 1 is provided with a charge injection layer 16 on the surface thereof. That is, the charge injection layer 16 is applied to an ordinary organic photosensitive drum comprising an aluminum drum base body (Al drum base body) 11 coated with an undercoating layer 12, a positive charge injection preventing layer 13, a charge producing layer 14 and a charge transporting layer 15 in the named order, thereby improving the charging performance.

The charge injection layer 16 is made by mixedly dispersing a lubricant and a polymerization starting agent such as $SnO_2$ super-fine particles 16*a* (having a diameter of about 0.03 μm) as electrically conductive particles (electrically conductive filler) and tetrafluoroethylene resin (trade name: Teflon) into photo-curing type acryl resin as a binder, and forming them into film by the photocuring method after the application thereof.

An important point as the charge injection layer 16 resides in the resistance of the surface layer. In the charging system by the direct injection of charges, the exchange of charges becomes capable of being done more efficiently by reducing the resistance of the member to be charged. On the other hand, when the member to be charged is used as an image bearing member (photosensitive member), it is necessary to hold an electrostatic latent image thereon for a predetermined time and therefore, the range of $1\times10^{9}$ to $1\times10^{14}$ (Ω·cm) is suitable as the volume resistance value of the charge injection layer 16.

Also, even when the charge injection layer is not used as in the present construction, an equal effect is obtained if for example, the charge transporting layer is within the above-mentioned range of resistance. A similar effect will be obtained even if use is made of an amorphous silicon photosensitive member or the like of which the volume resistance of the surface layer is about $10^{13}$ Ω·cm.

When in addition to the above-described charge accelerating particle applying method, by the use of a photosensitive drum having a charge injection layer, image outputting was effected in an apparatus similar to the apparatus described in Embodiment 2, zinc oxide particles which are charged accelerating particles impregnating the interior of a continuous bubble foaming body are exposed to the surface by the deformation of the vicinity of the surface of the charging roller 2 in the present embodiment, and simultaneously with the toner, the charge accelerating particles extraneously added to the toner are also present an untransferred particles on the photosensitive drum 1 and are collected and held on the surface of the charging roller and therefore, the charging roller 2 can keep a fine contacting property and contact resistance with respect to the photosensitive drum 1. Further, since the surface of the photosensitive drum is also formed by a charge injection layer, a more stable charging characteristic can be maintained for a long period of time.

Others

1) The charging roller 2 as the flexible contact charging member is not restricted to the charging rollers of the above-described embodiments.

2) When an AC voltage (an alternating voltage or a voltage of which the voltage value changes periodically) is included in the applied bias to the contact charging member 2 or the developing sleeve 3*a*, a sine wave, a rectangular wave, a triangular wave or the like is suitably usable as the waveform of the AC voltage. It may also be a rectangular wave formed by the periodical ON/OFF of a DC voltage source. As described above, as the waveform of the alternating voltage, use can be made of such a bias of which the voltage value changes periodically.

3) The image exposure means for electrostatic latent image formation is not restricted to the laser scanning exposure means for forming a digital latent image as in the embodiments, but may be other light emitting element such as an ordinary analogous image exposure element or an LED, or may be any means capable of forming an electrostatic latent image corresponding to image information, such as a combination of a light emitting element such as a fluorescent lamp and a liquid crystal shutter or the like.

4) The image bearing member may be an electrostatic recording dielectric member or the like. In this case, the surface of the dielectric member is uniformly primary-charged to a predetermined polarity and potential, and thereafter the charges are selectively moved by charge removing means such as a charge removing needle head or an electron gun to thereby write and form a desired electrostatic latent image.

5) While the developing means 3 has been described with respect to a reversal developing device using a monocomponent magnetic toner in the embodiments, the construction of the developing device is not particularly restricted, but may be a regular developing device.

6) The transferring means 4 is not limited to roller transfer, but may be arbitrary, for example, belt transfer, corona discharge transfer or the like.

7) The image forming apparatus may be an image forming apparatus using an intermediate transfer member such as a transfer drum or a transfer belt to form not only monochromatic images but also multicolor or full-color images by multitransfer or the like.

8) The image forming apparatus is not restricted to a transfer type image forming apparatus, but may be a direct type image forming apparatus or an image forming apparatus as an image display apparatus (display apparatus).

9) An example of a method of measuring the particle size of the toner will now be described. Coulter counter TA-2 type (produced by Coulter K.K.) is used as a measuring apparatus, and an interface (produced by Nikkaki K.K.) outputting a number average distribution and a volume average distribution and CX-1 personal computer (produced by Canon Inc.) are connected thereto, and as an electrolyte, 1% NaCl water solution is prepared by the use of first class sodium chloride.

As the measuring method, an interfacial active agent, preferably 0.1 to 5 ml of alkyl benzene sulfonate is added as a dispersing agent to 100 to 150 ml of the aforementioned electrolytic water solution, and a measurement sample of 0.5 to 50 mg is further added.

The electrolyte in which the sample is suspended is subjected to a dispersing process by an ultrasonic dispersing device for about 1 to 3 minutes, and the particle size distribution of particles of 2 to 40 μm is measured by the aforementioned Coulter counter TA-2 type by the use of an aperture of 100 μm as an aperture to thereby find volume average distributions. A volume average particle diameter is obtained from these volume average distributions.

As described above, according to the present invention, a stable and safe contact discharging device using no discharge phenomenon in which even when a simple member is used as a contact charging member, and in spite of the contamination of the contact charging member, a voltage corresponding to charging potential necessary to a member to be charged is sufficient as an applied bias necessary for the charging to the contact charging member, i.e., a direct injection charging device which requires a low applied voltage and which is ozoneless and excellent in the uniformity of charging and has stable performance for a long period of time, can be realized by a simple construction.

By using this charging device as the charging means for an image bearing member, with respect to an image recording apparatus of the contact charging system, an image recording apparatus of the contact charging system and the transfer system and further an image recording apparatus of the contact charging system, the transfer system and the toner recycle system, it is possible to use a simple member such as a charging roller or a fur brush as a charging member, and in spite of the toner contamination of the contact charging member, to execute ozoneless direct injection charging and toner recycle system by a low applied voltage without any problem, and to maintain the formation of images of high dignity for a long period of time, and maintain the formation of images of high dignity for a long period of time even after images of high image percentage have been outputted.

In the present invention, particularly an elastic foaming body of a continuous bubble material is used as the contact charging member and therefore, charge accelerating particles are stably and much borne in the continuous bubble material, and the nip portion is always maintained in a state in which a sufficient quantity of charge accelerating particles is interposed therein. Thereby, a stable charging property free of uneven charging is maintained for a long time from after the initial stage of the use of the apparatus.

While some embodiments of the present invention have been described above, the present invention is not restricted to these embodiments, but all modifications are possible within the technical idea thereof.

What is claimed is:

1. A charging device comprising:

a member to be charged a charging member for contacting with the member to be charged to thereby charge the member to be charged, said charging member having a surface layer including a foaming body made of a continuous bubble material; and charge accelerating particles releaseably held in the continuous bubble material.

2. A charging device according to claim 1, wherein said charging member being of a roller shape.

3. A charging device according to claim 1, wherein said charging member is moved with a speed difference relative to said member to be charged.

4. A charging device according to claim 1, wherein a resistance value of the charge accelerating particles is $1\times10^{12}$ Ω·cm or less.

5. A charging device according to claim 1, wherein the member to be charged has a photosensitive layer and a surface layer having a volume resistance of $10^{9}$ to $10^{14}$ Ω·cm.

6. A charging device according to claim 1, wherein said charge accelerating particles can be held on the surface layer outside the continuous bubble material.

7. A charging device comprising:

a charging member for charging a member to be charged, wherein said charging member forms a nip portion in cooperation with said member to be charged, said charging member having a surface layer including a foaming body made of a continuous bubble material; and conductive particles provided in the nip portion and releasably held in the continuous bubble material.

8. A charging device according to claim 7, wherein said charging member is of a roller shape.

9. A charging device according to claim 7, wherein said charging member moves with a speed difference relative to said member to be charged.

10. A charging device according to claim 7, wherein a resistance value of said conductive particles is $1\times10^{12}$ Ω·cm or less.

11. A charging device according to claim 7, wherein said member to be charged has a photosensitive layer and a surface layer having a volume resistivity of $10^{9}$ to $10^{14}$ Ω·cm.

12. A charging device according to claim 7, wherein said conductive particles are held on the surface layer formed on the continuous bubble material.

* * * * *

UNITED STATES PATENT AND TRADEMARK OFFICE

CERTIFICATE OF CORRECTION

PATENT NO. : 6,389,254 B2
DATED : May 14, 2002
INVENTOR(S) : Harumi Ishiyama et al.

It is certified that error appears in the above-identified patent and that said Letters Patent is hereby corrected as shown below:

Column 1,
Line 16, “charges)” should read -- charges from) --.

Column 2,
Line 3, “is” should read -- are --.

Column 3,
Line 9, “production of.” should read -- production of ions. --.

Column 4,
Line 19, “becomes more” should read -- becomes greater --.

Column 6,
Line 5, “Si” should read -- S1 --.

Column 8,
Line 45, “as” should read -- of --.

Column 9,
Line 31, “61” should read -- 81 --.

Column 12,
Line 35, “is” should read -- are --; and
Line 36, “is” should read -- are --.

Column 13,
Line 2, “continuous” should read -- continue --; and
Line 24, “mix” should read -- mixes --.

Column 15,
Line 33, “an” should read -- as --.

UNITED STATES PATENT AND TRADEMARK OFFICE

CERTIFICATE OF CORRECTION

PATENT NO. : 6,389,254 B2
DATED : May 14, 2002
INVENTOR(S) : Harumi Ishiyama et al.

It is certified that error appears in the above-identified patent and that said Letters Patent is hereby corrected as shown below:

Column 17,
Line 11, "stably and much borne" should read -- are more stable and borne --;
Line 23, "charged" should read -- charged; --; and
Line 33, "being" should read -- is --.

Signed and Sealed this

Twenty-third Day of July, 2002

*Attest:*

*Attesting Officer*

JAMES E. ROGAN
*Director of the United States Patent and Trademark Office*